US005586376A

United States Patent [19]

Enneking et al.

[11] Patent Number: 5,586,376

[45] Date of Patent: Dec. 24, 1996

[54] DECORATIVE CASKET CARRYING AND PRESENTATION TRAY

[75] Inventors: John R. Enneking; John Schultz, both of Batesville, Ind.

[73] Assignee: Batesville Casket Company, Batesville, Ind.

[21] Appl. No.: 327,579

[22] Filed: Oct. 24, 1994

[51] Int. Cl.[6] ..... A61G 17/00

[52] U.S. Cl. ..... 27/27; 294/15; 108/51.1

[58] Field of Search ..... 27/27, 35, 19; 294/15; 5/625; 108/18, 55.1, 51.1

[56] References Cited

U.S. PATENT DOCUMENTS

| | | | |
|---|---|---|---|
| D. 218,890 | 10/1970 | Kreminski . | |
| 235,376 | 12/1880 | Orr . | |
| 275,665 | 4/1883 | Johnson . | |
| 321,781 | 7/1885 | Barrett . | |
| 737,580 | 9/1903 | Carpenter | 27/27 |
| 878,985 | 2/1908 | Montross . | |
| 937,086 | 10/1909 | Montross | 27/27 |
| 1,292,268 | 1/1919 | De Camp | 27/27 |
| 1,468,111 | 9/1923 | Jones . | |
| 1,497,597 | 6/1924 | Scruggs . | |
| 2,198,997 | 4/1940 | Hickey . | |
| 2,759,239 | 8/1956 | Snyder . | |
| 2,802,253 | 8/1957 | Birck . | |
| 4,017,947 | 4/1977 | Acton | 27/27 |
| 4,064,574 | 12/1977 | Schnitzler | 5/627 |
| 4,216,933 | 8/1980 | Cramer | 108/51.1 X |
| 4,315,354 | 2/1982 | Behrendt | 27/27 |
| 4,372,018 | 2/1983 | Miller et al. | 27/27 X |
| 4,569,095 | 2/1986 | Holling | 5/625 X |

*Primary Examiner*—Carl D. Friedman
*Assistant Examiner*—Beth A. Aubrey
*Attorney, Agent, or Firm*—Wood, Herron & Evans

[57] ABSTRACT

A decorative casket carrying and presentation tray comprises a pair of side rails, a pair of end rails connected between the side rails, and a cross rail connected between the pair of side rails intermediate the end rails. Pallbearer handles are slidable within the end and cross rails to and between concealed, inoperable positions and exposed, operable positions. A stop block is pivotable to each end rail to and between a concealed, inoperable position and an exposed, operable position. The tray is fabricated of decorative wood.

22 Claims, 2 Drawing Sheets

DECORATIVE CASKET CARRYING AND PRESENTATION TRAY

FIELD OF THE INVENTION

This invention relates generally to caskets, and more particularly to a tray for carrying caskets and for the presentation of caskets.

BACKGROUND OF THE INVENTION

Caskets normally employ a plurality of handles or handlebars located around the exterior periphery of the casket for handling of the casket. These handles or handlebars are secured to the casket by the use of fastening hardware, for example, escutcheon plates and nuts and bolts. Typically, holes pierce the body of the casket and the escutcheon plates to which the handlebars are attached are secured to the casket by passing bolts through holes in the escutcheon plates and through holes in the casket wall and securing those bolts on the interior of the caskets with nuts.

Caskets which are to be used in the cremation process must normally have all of the metal trim, for example, handlebars, escutcheon plates and associated fasteners and the like, removed before encountering the cremation process. Removal of such hardware is tedious and time consuming. If the hardware is not included on the casket in the first instance, such that the hardware is not required to be subsequently removed, difficulties are encountered in handling and transporting the casket.

Prior casket carriers have generally been of a stark, utilitarian appearance. The appearance of such carriers thus required removal of the casket from the carrier before display or presentation of the casket.

It is therefore an objective of the present invention to provide a handling and presentation apparatus for lifting, maneuvering and presenting a casket for display purposes, yet without requiring the use of fasteners, which pierce the casket, to secure the handling apparatus to the casket.

It is another object of the present invention to provide an attractive casket carrier on which the casket can remain for display and presentation and for which the utilitarian aspects and features are subdued.

SUMMARY OF THE INVENTION

The present invention attains these objectives by providing a decorative casket carrying and presentation tray. The tray comprises a generally rectangular casket support, and pallbearer handles on either side of the support moveable between an exposed, operable position wherein the handles are graspable by a pallbearer and a concealed, inoperable position wherein the handles are hidden from view.

In another aspect, the tray includes a stop block on either end of the support moveable between an exposed, operable position blocking longitudinal movement of a casket atop the tray and a concealed, inoperable position allowing the casket to slide off an end of the tray.

The tray is preferably fabricated of decorative wood, for example attractively finished maple. During manipulation of the casket on the tray, the handles are positioned in their exposed, operable position to allow for lifting and maneuvering of the tray and casket atop the tray. Further, during this time the stop blocks are in their exposed, operable position to prevent the casket from sliding longitudinally on the tray. During presentation of the casket on the tray, the handles and stop blocks are moved to their concealed, inoperable positions thus giving the tray an appearance of an attractive, decorative presentation base for supporting the casket during presentation, rather than as simply a utilitarian carrying device.

In a preferred form, the tray of the present invention comprises a pair of side rails, a pair of end rails connected between the pair of side rails, and a cross rail connected between the pair of side rails intermediate the end rails. The pallbearer handles are slidable within the end rails and cross rail.

The end rails and cross rail each preferably define an inverted U-shaped channel which receives therein a pair of the pallbearer handles each of which is operable to slide into and out of one end of the channel. The pallbearer handle is an elongated rod preferably rectangular in cross section.

Each pallbearer handle preferably includes an elongated relieved area in a lower side thereof. The bottom of the tray includes upwardly projecting screws each having an end received within the relieved area of a respective pallbearer handle and functioning as a stop limiting movement of the handle in the exposed and concealed positions. Each pallbearer handle preferably includes a notch in the lower side of an outboard end permitting easy grasping of the handle by a pallbearer to extend the handle outwardly.

Each stop block comprises a rectangular block having a lip on an upper corner and being pivotally mounted to the end rail for pivoting movement within a slot in a top wall of the end rail. When the block is pivoted to the exposed position, the lip rests atop the top wall of the end rail, the block projecting upwardly above the top wall, and when the block is pivoted to the concealed position the block resides below the top wall.

The main advantage of the present invention is that a decorative casket carrying and presentation tray is provided which serves a utilitarian purpose in carrying and maneuvering cremation caskets which do not include handling hardware secured to the casket, and which also serves a decorative ornamental presentation purpose in providing an attractive display base for a casket at which time a number of utilitarian features, for example the pallbearer handles and stop blocks, may be concealed from view thereby accentuating the attractive display characteristics of the tray.

These and other objects and advantages of the present invention will become more readily apparent during the following detailed description taken in conjunction with the drawings herein, in which:

DETAILED DESCRIPTION OF THE INVENTION

Figure 1:
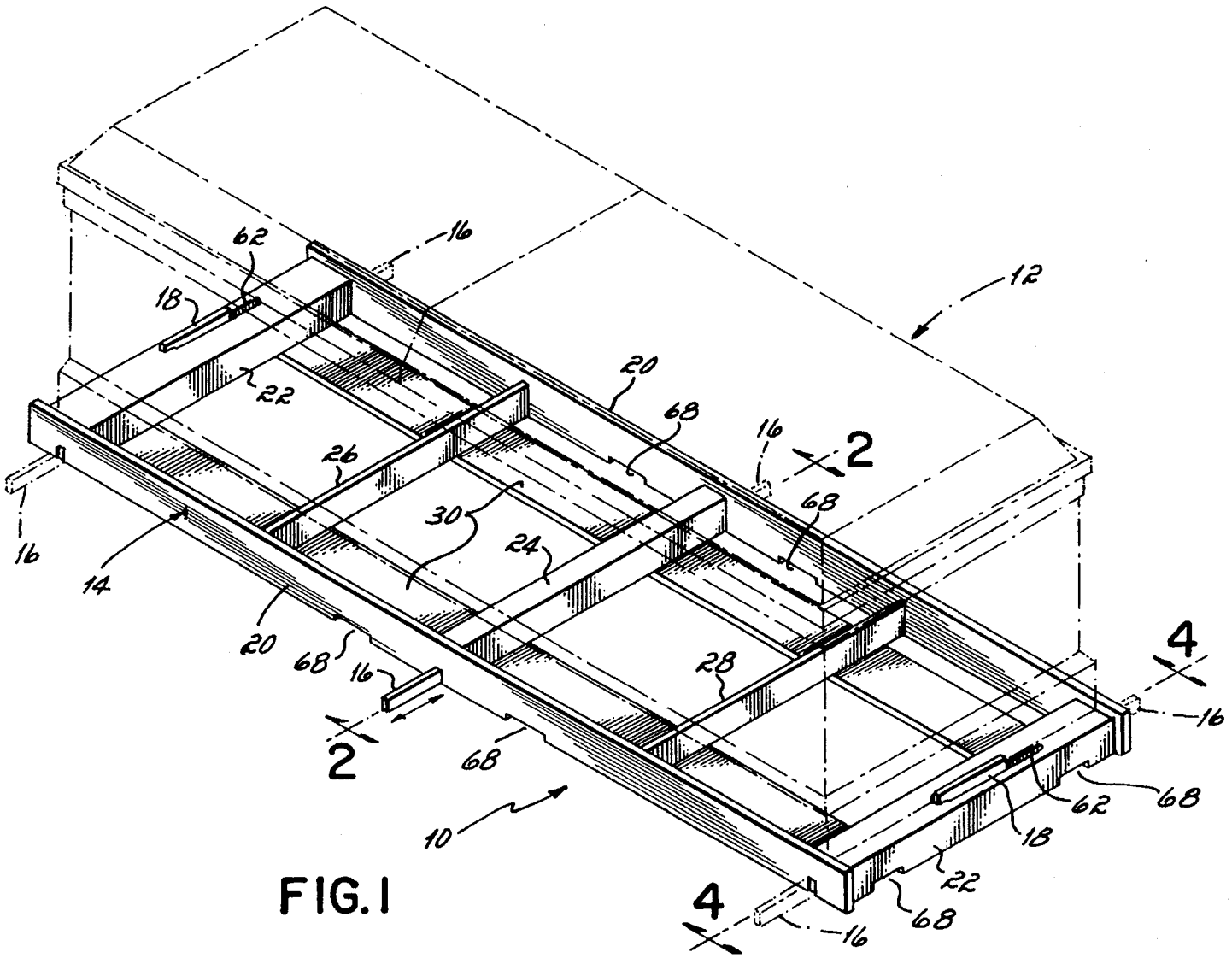
FIG. 1 is a perspective view of the decorative casket carrying and presentation tray of the present invention with a casket supported thereby shown in phantom.

Referring first to FIG. 1, a decorative casket carrying and presentation tray 10 according to the present invention is shown supporting a casket 12 (phantom) thereatop.

The tray 10 comprises, generally, a rectangular support 14, pallbearer handles 16 on either side of the support 14 moveable between exposed, operable positions wherein the handles are graspable by a pallbearer and concealed, inoperable positions wherein the handles are hidden from view, and a stop block 18 on either end of the support 14 moveable between an exposed, operable position blocking longitudinal movement of the casket 12 atop the tray 10 and a concealed, inoperable position allowing the casket 12 to slide off an end of the tray 10.

Referring now to all the Figures, and describing the tray 10 in more, but not limiting, detail, rectangular support 14 comprises a pair of side rails 20, a pair of end rails 22 connected between the side rails 20, a center cross rail 24 connected between the side rails 20 intermediate the end rails 22, and second and third cross rails 26, 28, respectively, connected between the side rails 20 intermediate each end rail 22 and the center cross rail 24. A pair of skids 30 underline the end and cross rails 22, 24, 26 and 28. All of the tray components are preferably fabricated of a decorative wood, for example attractively finished maple.

Figures 2, 3, 4, 5:
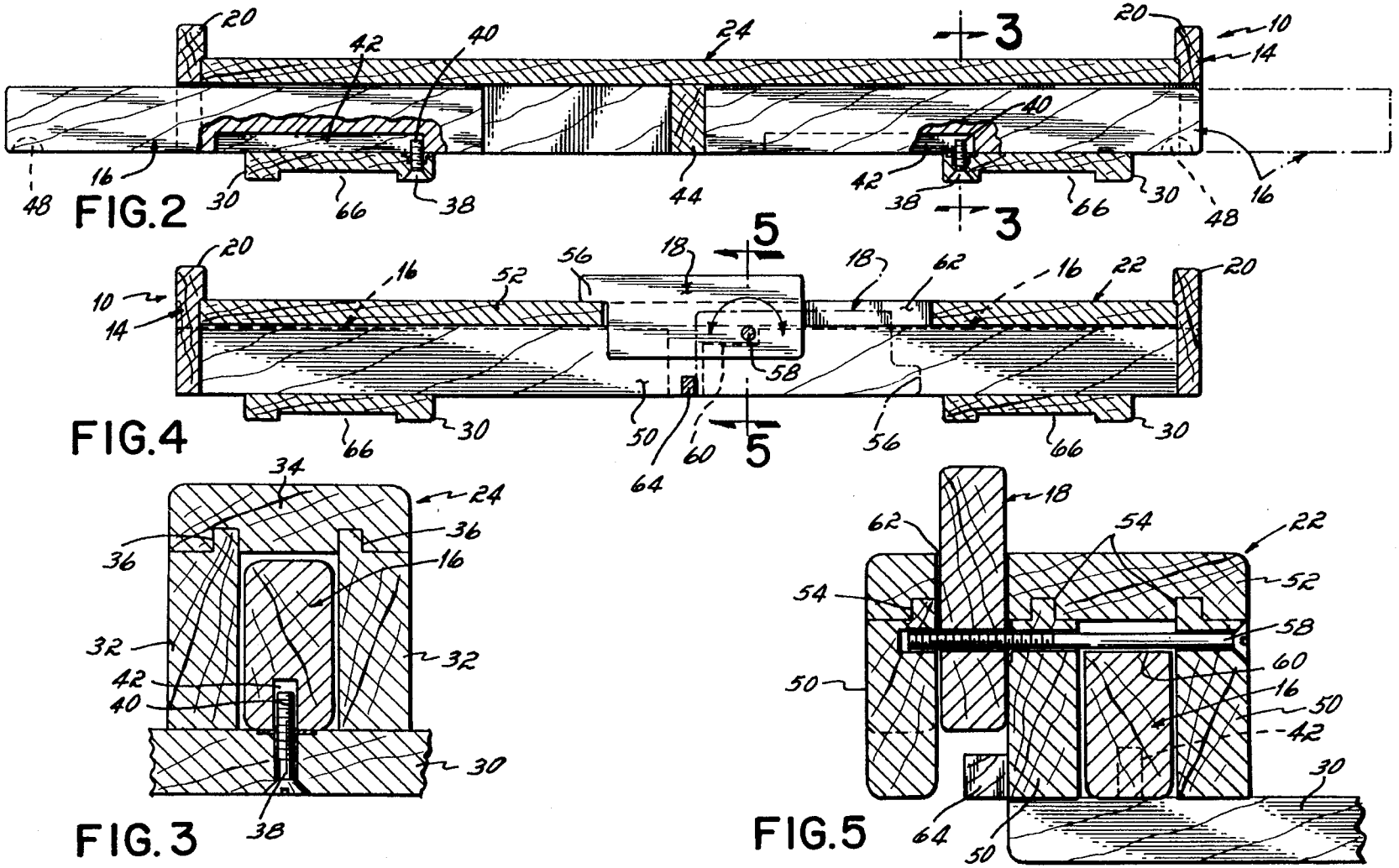
FIG. 2 is a view taken along line 2—2 of FIG. 1.
FIG. 3 is a view taken along line 3—3 of FIG. 2.
FIG. 4 is a view taken along line 4—4 of FIG. 1.
FIG. 5 is a view taken along line 5—5 of FIG. 4.

As seen in FIG. 3, center cross rail 24 is in the form of in inverted U-shaped channel having side wall portions 32 and a top wall portion 34 secured to the upper ends of the side wall portions 32 as by tongue in groove joints 36 and suitable wood glue. Pallbearer handle 16, an elongated rod generally rectangular in cross section, is slidably received within the inverted U-shaped channel of the center cross rail 24. A screw 38 passes through the skid 30 and has an end 40 received within an elongated groove 42 of each pallbearer handle 16. Screws 38 thus function as stops limiting movement of the handle 16 in their exposed and concealed positions. As seen in FIG. 2, a wall member 44 centered transversely of the tray 10 divides the center cross rail 24 into two portions, each of which receives a respective pallbearer handle 16 operable to slide into and out of a respective outboard end of the rail 24. To aid in grasping the handles 16 in order to slide them from their concealed, inoperable position outwardly to their exposed, operable position, a notch 48 is provided in a lower side of an outboard end of each of the handles 16 permitting easy grasping of the handle 16 by a pallbearer.

As seen in FIGS. 4 and 5, each end rail 22 has three side wall members 50 and a top wall member 52 secured to the upper ends of the side wall members 50 via tongue in groove joints 54 and suitable wood glue. The rails 22 each thus define a pair of inverted U-shaped channels, one of which receives a pair of the sliding pallbearer handles 16, the other of which receives stop block 18. Each stop block 18 is generally rectangularly shaped and includes a lip 56 on an upper corner thereof. The block 18 is pivotally mounted between a pair of the side walls 50 via a screw 58. Each of the handles 16 in each of the end rails 22 includes a notch 60 to provide clearance for the screw 58. As seen in FIGS. 4 and 5, the block 18 is pivotally mounted to the end rail 22 for pivoting movement within a slot 62 to the top wall 52 of each end rail 22. When the block 18 is pivoted to the exposed position the lip 56 rests atop the top wall 52 of the end rail 22, at which time the block 18 projects upwardly above the top wall 52. When the block 18 is pivoted to the concealed position, the block 18 resides below the top wall 52. A stop 64 is adhesively secured to the lower end of one of the side walls 50 thereby maintaining the block 18 in a generally parallel relationship with the rail 22 and contained within the rail 22 when pivoted to the inoperable position.

Skids 30 are connected to the lower sides of the rails 22, 24, 26 and 28 with wood glue. In addition, side rails 20 are secured to the ends of the rails 22, 24, 26 and 28 with wood screws (not shown) which are counter sunk into the side rails, the resulting holes of which are plugged with wooden plugs (not shown) in order to conceal the screws.

A plastic runner (not shown) preferably spans the width of each end rail 22 longitudinally inboard of the stop block notch 62. The plastic rails are to prevent damage to the tray 10 as the casket 12 is slid off of the tray 10. The skids 30 each preferably include a longitudinal groove 66 therein for mating with structure within the church vehicle. Additionally, the skids 30 are preferably sized an appropriate length to also mate with the church vehicle structure. Grooves 68 are provided in the lower side of each of the rails 20, one on either side of the center handle 16, and two grooves 68 in the lower side of each of the rails 22. The grooves serve as additional handles for the tray 10 and come into use when the tray is handled in the funeral home, where normally only two people are involved in handling and manipulating the tray. The number and position of the grooves 68 provide for superior balance and control of the tray than if the handles 16 were used by just the two people.

In use, the casket 12 is placed atop the tray 10. Stop blocks 18 are then rotated from their concealed, inoperable positions to their exposed, operable positions to restrain the casket 12 longitudinally on the tray 10 during carrying. Handles 16 are then grasped via notches 48 and slid outwardly from their concealed, inoperable positions to their exposed, operable positions. The casket 12 and tray 10 may then be carried and maneuvered, etc. by pallbearers or other personnel with the handles 16. During presentation, the handles 16 and stop blocks 18 are moved to their concealed, inoperable positions, hidden from view. Thus, the ornamental, decorative aspects of the tray 10 are featured while at the same time downplaying the utilitarian aspects of the tray 10.

Those skilled in the art will readily recognize numerous adaptations and modifications which can be made to the present invention and which will result in an improved decorative casket carrying and presentation tray, yet all of which will fall within the spirit and scope of the present invention as defined in the following claims. Accordingly, the invention is to be limited only by the scope of the following claims and their equivalents.

What is claimed is:

1. A decorative casket carrying and presentation tray comprising:

a generally rectangular casket support adapted to bear and display a casket thereon; and pallbearer handles mounted on either side of said support movable laterally into and out of said support to and between an exposed, operable position wherein said handles are graspable by a pallbearer and a concealed, inoperable position wherein the laterally outboard ends of said handles are flush with said support and said handles are hidden from view.

2. A decorative casket carrying and presentation tray comprising:

a generally rectangular casket support;

pallbearer handles on either side of said support moveable between an exposed, operable position wherein said handles are graspable by a pallbearer and a concealed, inoperable position wherein said handles are hidden from view; and a stop block on either end of said support movable between an exposed, operable position blocking longitudinal movement of a casket atop said tray and a concealed, inoperable position allowing the casket to slide off an end of said tray.

3. A decorative casket carrying and presentation tray comprising:

a generally rectangular casket support; and a stop block on either end of said support movable between an exposed, operable position blocking longitudinal movement of a casket atop said tray and a concealed, inoperable position allowing the casket to slide off an end of said tray.

4. A decorative casket carrying and presentation tray comprising:

a pair of side rails;

means forming a bottom of said tray between said side rails adapted to bear and display a casket thereon; and pallbearer handles mounted on either side of said tray moveable laterally into and out of said side rails to and between an exposed, operable position wherein said handles are graspable by a pallbearer and a concealed, inoperable position wherein the laterally outboardmost ends of said handles are flush with said side rails and said handles are hidden from view.

5. A decorative casket carrying and presentation tray comprising:

a pair of side rails;

means forming a bottom of said tray between said side rails adapted to bear and display a casket thereon; and pallbearer handles on either side of said tray moveable between an exposed, operable position wherein said handles are graspable by a pallbearer and a concealed, inoperable position wherein said handles are hidden from view;

said tray further comprising:

a pair of end rails connected between said pair of side rails; and a cross rail connected between said pair of side rails intermediate said end rails;

said pallbearer handles being slidable within said end rails and cross rail.

6. The tray of claim 5 wherein said side rails, end rails, cross rail and bottom means are fabricated of decorative wood.

7. The tray of claim 6 wherein said decorative wood is maple.

8. The tray of claim 5 wherein:

said end rails and cross rail each define an inverted U-shaped channel which receives therein a pair of said pallbearer handles each of which is operable to slide into and out of one end of said channel; and wherein each said pallbearer handle is an elongated rod rectangular in cross-section.

9. The tray of claim 8 wherein:

each said pallbearer handle includes an elongated relieved area in a lower side thereof; and said bottom means includes an upwardly projecting screw having an end received within said relieved area of each said pallbearer handle and functioning as a stop limiting movement of said handle in said exposed and concealed positions.

10. The tray of claim 9 wherein each said pallbearer handle includes a notch in a lower side of an outboard end thereof permitting easy grasping of said handle by a pallbearer.

11. A decorative casket carrying and presentation tray comprising:

a pair of slide rails;

means forming a bottom of said tray between said side rails;

pallbearer handles on either side of said tray moveable between an exposed, operable position wherein said handles are graspable by a pallbearer and a concealed, inoperable position wherein said handles are hidden from view; and a stop block on each said end rail and movable between an exposed, operable position blocking longitudinal movement of a casket atop said tray and a concealed, inoperable position allowing the casket to slide off an end of said tray.

12. The tray of claim 11 wherein each said stop block comprises:

a rectangular block having a lip on an upper corner thereof;

said block being pivotally mounted to said end rail for pivoting movement within a slot in a top wall of said end rail;

wherein when said block is pivoted to said exposed position said lip rests atop said top wall of said end rail, said block projecting upwardly above said top wall, and when said block is pivoted to said concealed position said block resides below said top wall.

13. A decorative casket carrying and presentation tray comprising:

a pair of side rails;

a pair of end rails connected between said pair of side rails;

means forming a bottom of said tray between said side rails;

pallbearer handles on either side of said tray graspable by a pallbearer; and a stop block mounted to each said end rail and movable between an exposed, operable position blocking longitudinal movement of a casket atop said tray and a concealed, inoperable position allowing the casket to slide off an end of said tray.

14. The tray of claim 13 wherein said side rails, end rails, and bottom means are fabricated of decorative wood.

15. The tray of claim 14 wherein said decorative wood is maple.

16. The tray of claim 13 wherein each said stop block comprises:

a rectangular block having a lip on an upper corner thereof;

said block being pivotally mounted to said end rail for pivoting movement within a slot in a top wall of said end rail;

wherein when said block is pivoted to said exposed position said lip rests atop said top wall of said end rail, said block projecting upwardly above said top wall, and when said block is pivoted to said concealed position said block resides below said top wall.

17. A decorative casket carrying and presentation tray comprising:

a pair of side rails;

a pair of end rails connected between said pair of side rails;

a center cross rail connected between said pair of side rails intermediate said end rails;

second and third cross rails connected between said pair of side rails intermediate each said end rail and said center cross rail;

a pair of skids underlying said end and cross rails;

pallbearer handles slidable within said end rails and center cross rail between an exposed, operable position wherein said handles are graspable by a pallbearer and a concealed, inoperable position wherein said handles are hidden from view; and a stop block pivotally mounted to each said end rail and movable between an exposed, operable position blocking longitudinal movement of a casket atop said tray and a concealed, inoperable position allowing the casket to slide off an end of said tray.

18. The tray of claim 17 wherein said tray is fabricated of maple.

19. The tray of claim 17 wherein:

said end rails and center cross rail each define an inverted U-shaped channel which receives therein a pair of said pallbearer handles each of which is operable to slide into and out of one end of said channel; and wherein each said pallbearer handle is an elongated rod rectangular in cross-section.

20. The tray of claim 17 wherein:

each said pallbearer handle includes an elongated relieved area in a lower side thereof; and said skids include an upwardly projecting screw having an end received within said relieved area of each said pallbearer handle and functioning as a stop limiting movement of said handle in said exposed and concealed positions.

21. The tray of claim 17 wherein each said pallbearer handle includes a notch in a lower side of an outboard end thereof permitting easy grasping of said handle by a pallbearer.

22. The tray of claim 17 wherein each said stop block comprises:

a rectangular block having a lip on an upper corner thereof;

said block being pivotally mounted to said end rail for pivoting movement within a slot in a top wall of said end rail;

wherein when said block is pivoted to said exposed position said lip rests atop said top wall of said end rail, said block projecting upwardly above said top wall, and when said block is pivoted to said concealed position said block resides below said top wall.

* * * * *

UNITED STATES PATENT AND TRADEMARK OFFICE

CERTIFICATE OF CORRECTION

PATENT NO. : 5,586,376
DATED : December 24, 1996
INVENTOR(S) : John Enneking and John Schultz It is certified that error appears in the above-indentified patent and that said Letters Patent is hereby corrected as shown below:

Column 5, line 62, "slide" should be -- side --.

Signed and Sealed this

Seventh Day of October, 1997

*Attest:*

*Attesting Officer*

Bruce Lehman

BRUCE LEHMAN

*Commissioner of Patents and Trademarks*